US005176506A

United States Patent [19]

Siebel

[11] Patent Number: 5,176,506

[45] Date of Patent: Jan. 5, 1993

[54] VENTED COMPRESSOR LUBRICATION SYSTEM

[75] Inventor: Stephen M. Siebel, Sidney, Ohio

[73] Assignee: Copeland Corporation, Sidney, Ohio

[21] Appl. No.: 560,439

[22] Filed: Jul. 31, 1990

[51] Int. Cl.[5] ..... F04B 17/00; F04B 39/02; F04B 39/06

[52] U.S. Cl. ..... 417/368; 184/6.16; 184/6.18; 416/181; 418/88; 418/89; 418/94

[58] Field of Search ..... 417/251, 368, 423.8, 417/423.9, 424.1, 247, 201, 203, 902, 313; 418/88, 89, 94, 47; 415/168.1; 416/181; 184/6.18, 6.16

[56] References Cited

U.S. PATENT DOCUMENTS

| | | | |
|---|---|---|---|
| 3,162,360 | 12/1964 | Privon et al. . | |
| 3,312,177 | 4/1967 | Eckerle et al. | 418/47 |
| 3,584,980 | 6/1971 | Cawley . | |
| 3,887,035 | 6/1975 | Hannibal . | |
| 3,926,281 | 12/1975 | Hannibal . | |
| 4,111,612 | 9/1978 | Paczuski | 417/372 |
| 4,421,453 | 12/1983 | Hoff et al. | 417/368 |
| 4,470,772 | 9/1984 | Gannaway | 417/902 |
| 4,516,916 | 5/1985 | English et al. | 417/368 |
| 4,621,993 | 11/1986 | Nakamura et al. | 418/88 |
| 4,702,681 | 10/1987 | Inaba et al. | 418/94 |
| 4,792,296 | 12/1988 | Kobayashi et al. | 418/55.6 |
| 4,911,620 | 3/1990 | Richardson | 417/902 |
| 5,017,108 | 5/1991 | Murayama et al. | 418/88 |
| 5,019,136 | 5/1991 | Elonen et al. | 415/168.1 |

FOREIGN PATENT DOCUMENTS

| | | | |
|---|---|---|---|
| 552978 | 12/1956 | Italy | 418/47 |
| 58-202385 | 11/1983 | Japan | 417/368 |
| 62-45991 | 2/1987 | Japan | 418/88 |

OTHER PUBLICATIONS

Drawings–Industrial Specifications Drawings Used by Copeland Co. as early as Jun. 1966.

*Primary Examiner*—Leonard E. Smith
*Assistant Examiner*—Roland McAndrews
*Attorney, Agent, or Firm*—Harness, Dickey & Pierce

[57] ABSTRACT

An improved lubrication system for a refrigeration compressor is disclosed which lubrication system incorporates filtering arrangement for filtering lubricant supplied to a two stage lubricant pump and unique venting arrangement for venting gaseous refrigerant entrained within the lubricant. The two stage pump incorporates a vent passage in the first stage portion thereof which aids in avoiding a possible interruption of lubricant flow due to gaseous refrigerant within the first stage. A second radially extending restricted vent passage is provided in the drive shaft intermediate the ends thereof which is also designed to vent gaseous refrigerant while resisting the flow of lubricant therethrough so as to avoid priming thereof which could enable the passage to begin pumping lubricant.

42 Claims, 4 Drawing Sheets

VENTED COMPRESSOR LUBRICATION SYSTEM

BACKGROUND AND SUMMARY OF THE INVENTION

The present invention relates generally to lubrication systems for refrigeration compressors and more specifically to such lubrication systems incorporating two stage lubricant pumps having a venting arrangement for venting of gaseous refrigerant entrained within the lubricant as well as an improved distribution passage vent and filtration means operative to restrict the circulation of foreign particles entrained within the lubricant.

Hermetic refrigeration compressors typically incorporate an outer shell having a lubricant sump in the bottom thereof from which lubricant is pumped to the various bearings via axial and radial passages within a drive shaft. Because the sump and lubricant contained therein is in open communication with the refrigerant, some refrigerant may become intermixed therewith in both liquid and gaseous form. Because this refrigerant is often carried into the lubrication pump and passages during operation thereof, it is desirable to provide means to vent the lubricant passages so as to avoid the potential for insufficient lubrication due to the presence of this refrigerant. However, it is possible for such vent passages to act as pumps should they become primed thus short circuiting the oil flowpath.

In some compressors, particularly variable speed compressors, it is necessary to incorporate a multistage oil pump in order to insure sufficient lubrication of the bearings at slower operating speeds because the oil pump output is proportional to the speed at which the compressor is operating. In such two stage pumps, it is possible for liquid refrigerant to be flashed at the first stage thus forming gaseous bubbles within the pump thus reducing the amount of lubricant which the pump is able to supply. Accordingly, it is desirable to provide means to vent such refrigerant so as to increase the volume of lubricant being supplied by the pump.

A certain amount of foreign particles will inevitably be trapped inside a fully assembled compressor in spite of the best efforts to avoid same. Additionally, as the compressor wears both during initial run in periods as well as during on-going operations, it is possible for further particles to accumulate within the lubricating oil. While it is virtually impossible to completely eliminate the presence of such particles, it is possible and desirable to incorporate means to prevent such circulation of any foreign particles.

The present invention provides a lubrication system which incorporates these various features so as to thereby insure an adequate continuous supply of lubricant irrespective of the operating speed of the compressor while also minimizing the circulation of foreign particles therewith. In order to achieve these objectives, a two stage oil pump is provided which incorporates vent passage means within the first stage to reduce the amount of gaseous refrigerant carried to the second stage and thus assure increased oil flow thereto. Further, a unique anti-syphon venting passage is provided in an upper portion of the crankshaft to further reduce the possibility of refrigerant within the oil preventing adequate lubrication of the various bearing surfaces. Further, a filtering screen is incorporated within the lubricant sump to reduce the possibility of foreign particles being drawn into the pump and circulated to the bearings. These features render the lubrication system of the present invention uniquely well suited for use in variable speed compressors as they combine to assure an adequate supply of lubricant is supplied to the bearing surfaces regardless of the operating speed of the compressor.

Additional advantages and features of the present invention will become apparent from the subsequent description and the appended claims taken in conjunction with the accompanying drawings.

DETAILED DESCRIPTION OF THE PREFERRED EMBODIMENTS

Figure 1:
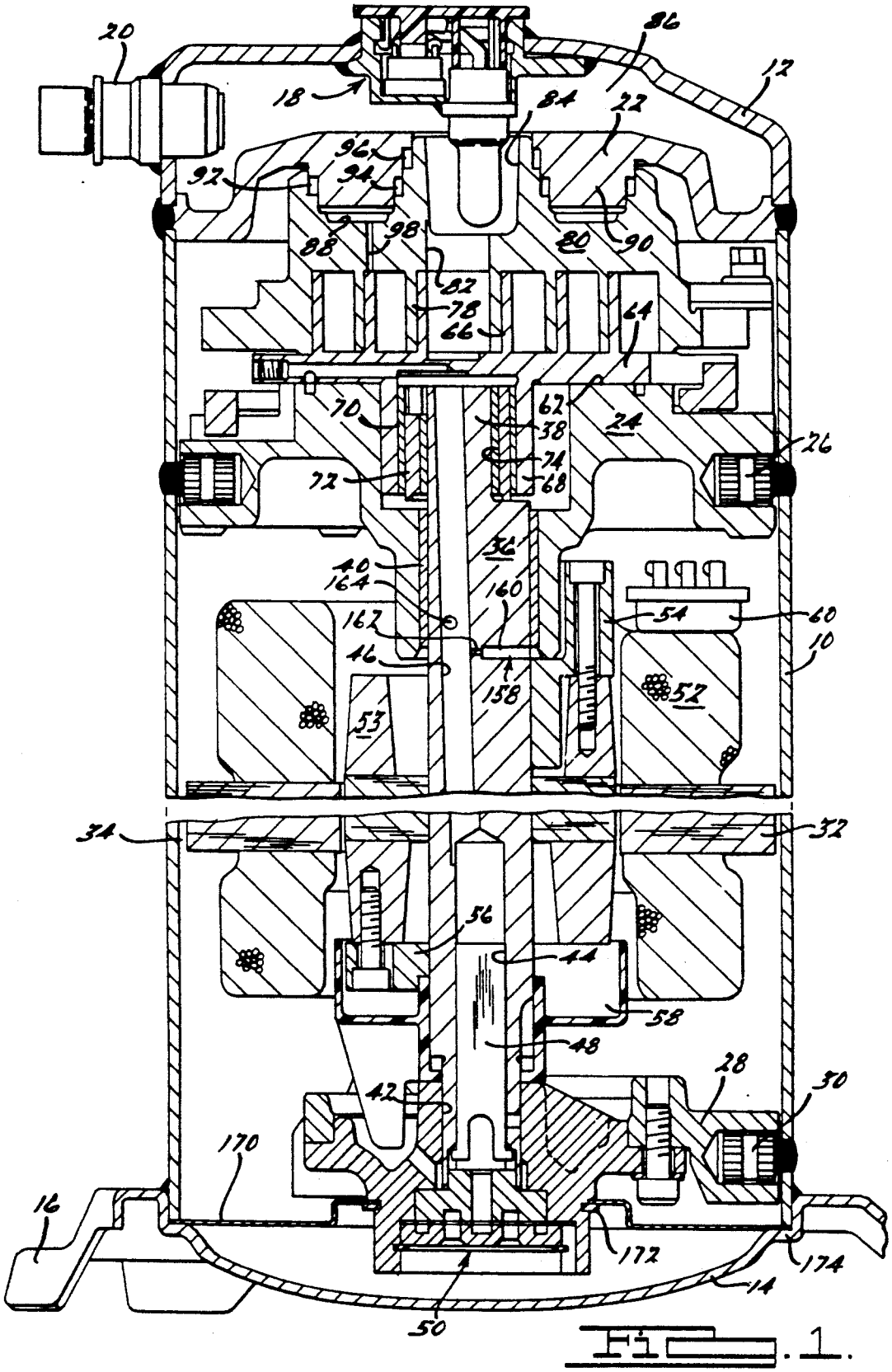
FIG. 1 is a section view of a scroll type refrigeration compressor incorporating a lubrication system in accordance with the present invention.

While the present invention is suitable for incorporation in many different types of compressors for exemplary purposes it will be described herein incorporated in a scroll compressor of the general structure illustrated in vertical section in FIG. 1. The compressor comprises a generally cylindrical hermetic shell 10 having welded at the upper end thereof a cap 12 and at the lower end thereof a base 14 having a plurality of feet 16. Cap 12 is provided with a thermostat assembly indicated generally at 18 which has a portion extending into the interior of the shell, and a refrigerant discharge fitting 20 which may have the usual discharge valve therein (not shown). Other major elements affixed to the shell include a transversely extending partition 22 which is welded about its periphery at the same point that cap 12 is welded to shell 10, a main bearing housing 24 which is pin welded to shell 10 at a plurality of points utilizing pins 26, and a lower bearing housing 28 also having a plurality of radially outwardly extending legs each of which is pin welded to shell 10 utilizing a pin 30. A motor stator 32 which is generally square in cross section but with the corners rounded off is press fit into shell 10. The flats between the rounded corners on the stator provide passageways between the stator and shell, indicated at 34 which facilitate the flow of lubricant from the top of the shell to the bottom. A drive shaft or crankshaft 36 having an eccentric crank pin 38 at the upper end thereof is rotatably journaled in a bearing 40 in main bearing housing 24 and a second bearing 42 in lower bearing housing 28. Crankshaft 36 has at the lower end a relatively large diameter concentric bore 44 which communicates with a radially outwardly inclined smaller diameter bore 46 extending upwardly therefrom to the top of the crankshaft. Disposed within bore 44 is a stirrer 48 and keyed to the bottom of the crankshaft is a lubricating oil pump indicated generally at 50. The lower portion of the interior shell 10 is filled with lubricating oil and pump 50 is the primary pump acting in conjunction with bore 44 which acts as a secondary pump to pump lubricating fluid up the crankshaft and into passageway 46 and ultimately to all of the various portions of the compressor which require lubrication.

Crankshaft 36 is rotatively driven by an electric motor including stator 32, windings 52 passing therethrough and a rotor 53 press fit on the crankshaft and having upper and lower counterweights 54 and 56 respectively. The lubrication oil level being sufficient so that counterweight 56 is spinning in same. A counterweight shield 58 may be provided to reduce the work loss caused by counterweight 56 spinning in the oil in the sump. The usual motor protector 60 may be affixed to the windings in order to provide conventional overheating protection.

The upper surface of main bearing housing 24 is provided with a flat thrust bearing surface 62 on which is disposed an orbiting scroll 64 having the usual spiral vane or wrap 66 on the upper surface thereof. Projecting downwardly from the lower surface of orbiting scroll 64 is a cylindrical hub having a journal bearing 70 therein and in which is rotatively disposed a drive bushing 72 having an inner bore 74 in which crank pin 38 is drivingly disposed. Crank pin 38 has a flat on one surface which drivingly engages a flat surface formed in a portion of bore 74 (not shown) to provide a radially compliant driving arrangement, such as shown in assignee's U.S. Pat. No. 4,877,382, the disclosure of which is herein incorporated by reference. Wrap 66 meshes with a non-orbiting spiral wrap 78 forming a part of non-orbiting scroll 80 which is mounted to main bearing housing 24 in any desired manner which will provide limited axial movement of scroll member 80 (the manner of such mounting not being relevant to the present invention). Non-orbiting scroll member 80 has a centrally disposed discharge passageway 82 communicating with an upwardly open recess 84 which is in fluid communication with the discharge muffler chamber 86 defined by cap 12 and partition 22. Non-orbiting scroll member 80 has in the upper surface thereof an annular recess 88 in which is sealingly disposed for relative axial movement an annular piston 90 integrally formed on partition 22. Annular elastomer seals 92, 94 and 96 serve to isolate the bottom of recess 88 from the presence of gas under discharge pressure so that it could be placed in fluid communication with a source of intermediate fluid pressure by means of a passageway 98. The non-orbiting scroll member is thus axially biased against the orbiting scroll member by the forces created by discharge pressure acting on the central portion of the scroll member and those created by intermediate fluid pressure acting on the bottom of recess 88. This axial pressure biasing is disclosed in much greater detail in assignee's above referenced U.S. Patent.

The scroll compressor as thus far broadly described is either know in the art or the subject matter of other pending applications for patent. The details of construction which incorporate the principals of the present invention are those which deal with the lubrication system for the compressor including more specifically a venting arrangement for primary pump 50 and associated impeller design therefor, the provision of filtration means to reduce the likelihood of foreign particles being ingested by pump 50 and supplied to the bearings and a unique venting arrangment for the primary lubricant supply passage 46.

Figure 3:
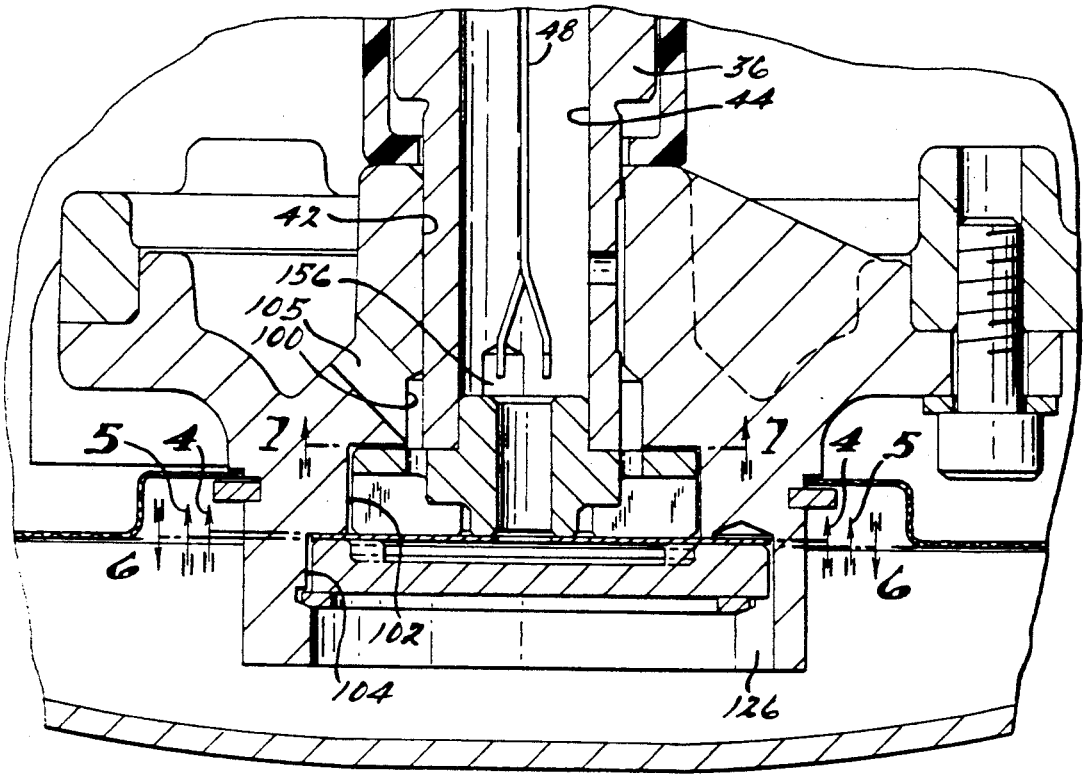
FIG. 3 is a view similar to that of FIG. 2 but with the crankshaft rotated and the section taken generally perpendicular to the section of FIG. 2.
Figure 2:
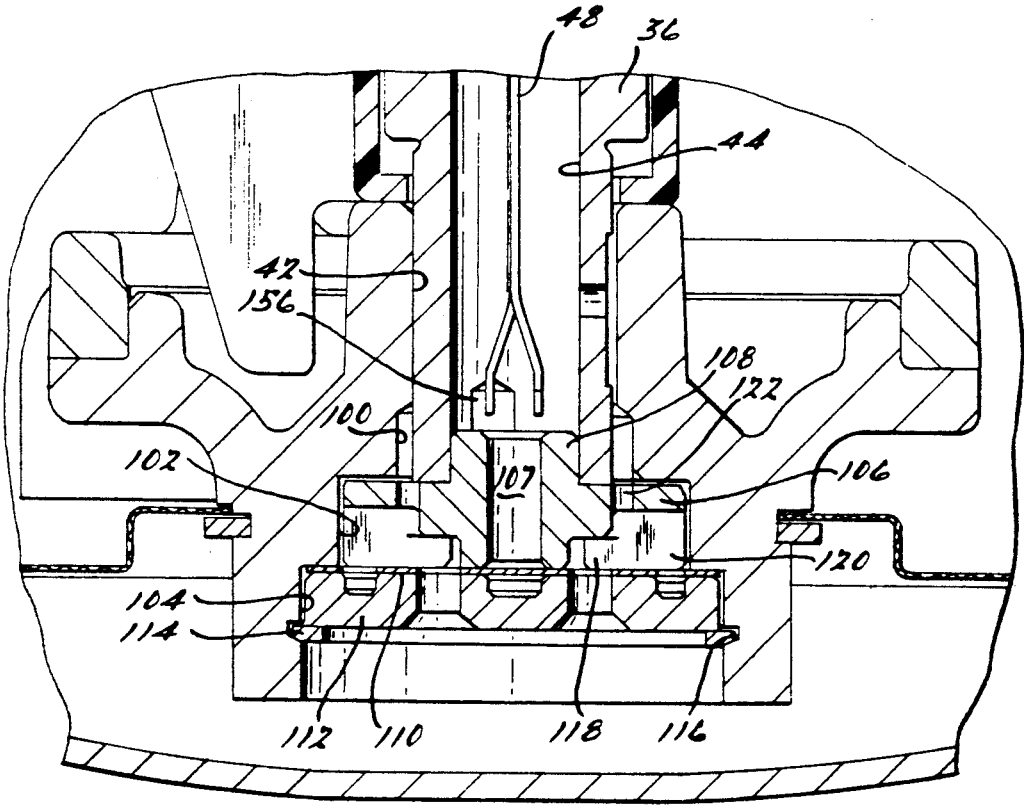
FIG. 2 is an enlarged fragmentary section view of the compressor of FIG. 1 showing the two stage oil pump and associated vent.

As best seen with reference to FIGS. 2 and 3, lower bearing housing 28 has a series of three counterbores 100, 102, 104 each being slightly larger in diameter than the immediately adjacent counterbore, with the smallest thereof 100 being located immediately adjacent bearing 42. As shown, the lower end of crankshaft 36 is positioned generally at the juncture between counterbores 100 and 102. A diagonally extending passage 105 is also provided in bearing housing 28 opening into counterbore 100 through a sidewall thereof.

An impeller member 106 is rotatably positioned within counterbore 102 and includes an upwardly extending reduced diameter portion 108 extending into bore 44 of crankshaft 36. A thrust washer 110 and plate member 112 are positioned within counterbore 104 being retained therein by a snap ring 114 fitted within an annular groove 116 provided in the sidewall of counterbore 104 and serve to retain impeller member 106 in assembled relationship with crankshaft 36.

Figure 4:
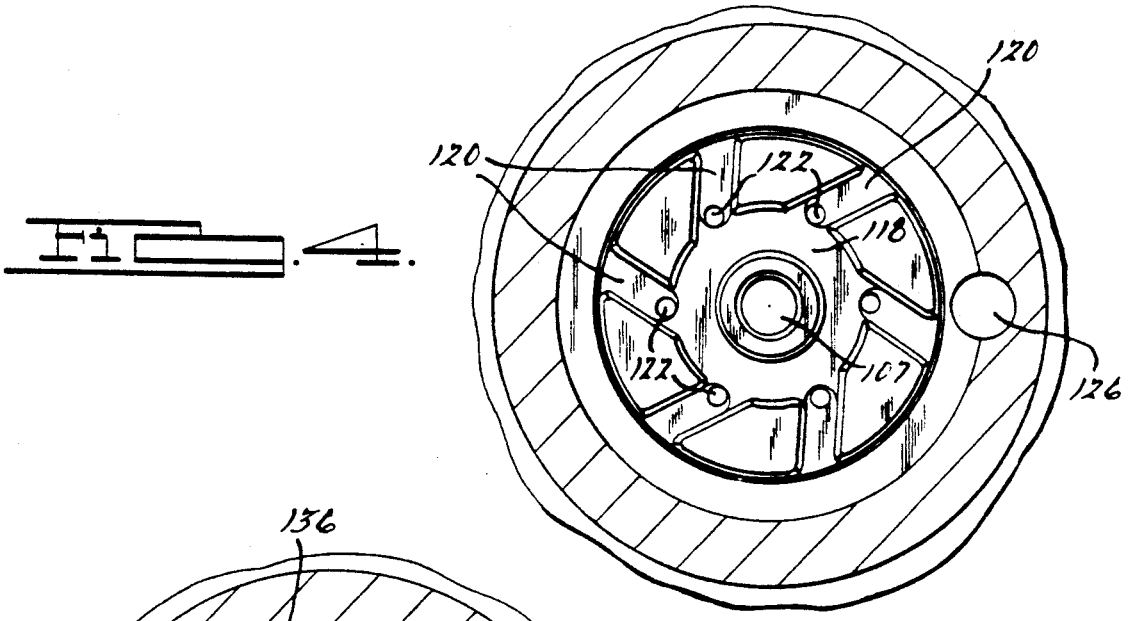
FIGS. 4, 5, 6 and 7 are enlarged section views of the oil pump shown in FIGS. 2 and 3, the sections being taken along lines 4—4, 5—5, 6—6, and 7—7 respectively of FIG. 3.

Referring now to FIG. 4, the lower surface of pump impeller 106 includes an axially extending center bore 107 which opens upwardly into crankshaft passage 44 and an annular recess 118 positioned radially outwardly of bore 107 and coaxially with the axis of rotation thereof. A plurality of pumping passages 120 extend outwardly from recess 118 to the outer periphery of impeller 106. Preferably, passages 120 are angled slightly relative to a true radius so as to extend along a chord of impeller 106 and are stepped in an axial direction adjacent the juncture with recess 118 so as to increase the downstream cross sectional area thereof as compared to the point at which passages 120 open into annular recess 118. A relatively small diameter axially extending passage 122 is also provided being located at the juncture of each passage 120 with annular recess 118.

Figure 5:
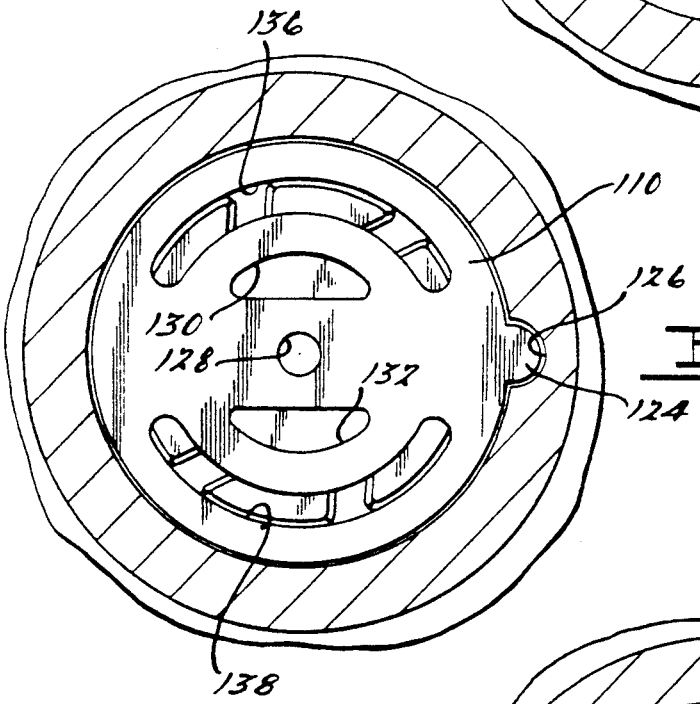
Figure 6:
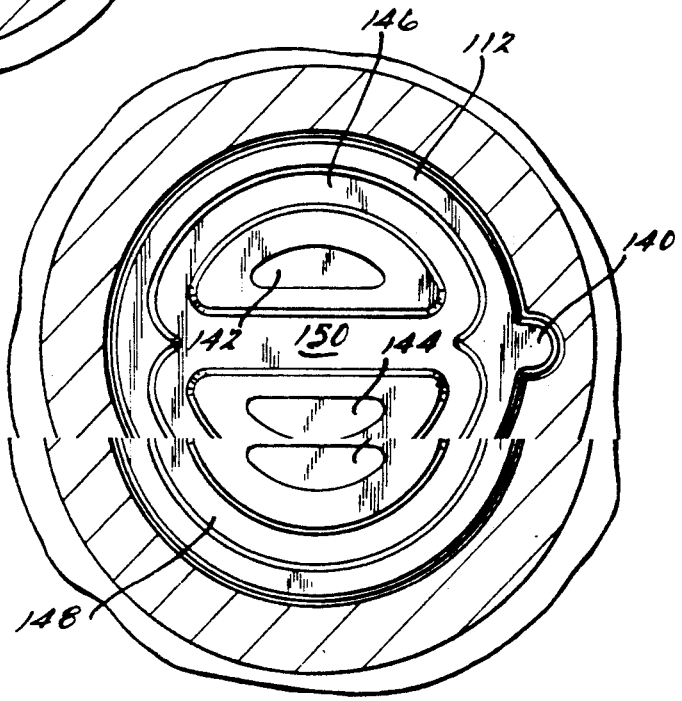
Figure 7:
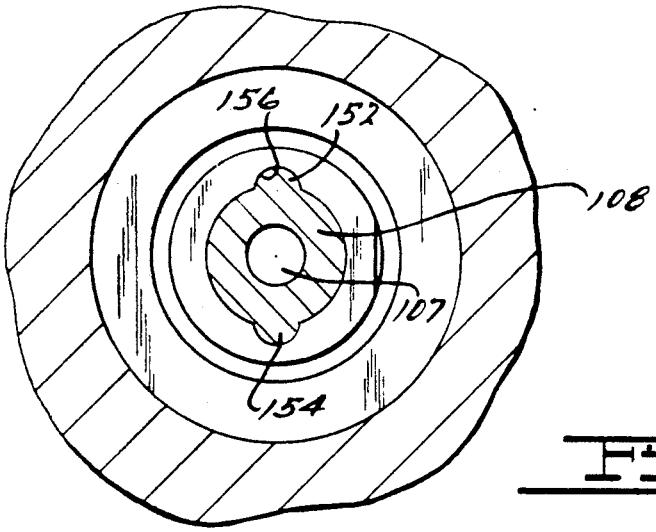
Figure 8:
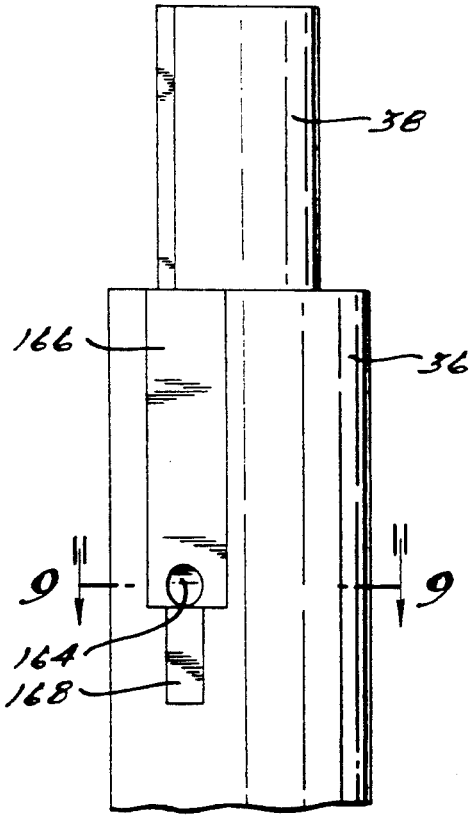
FIG. 8 is an enlarged fragmentary view of an upper portion of the drive shaft shown in FIG. 1 in accordance with the present invention.
Figure 9:
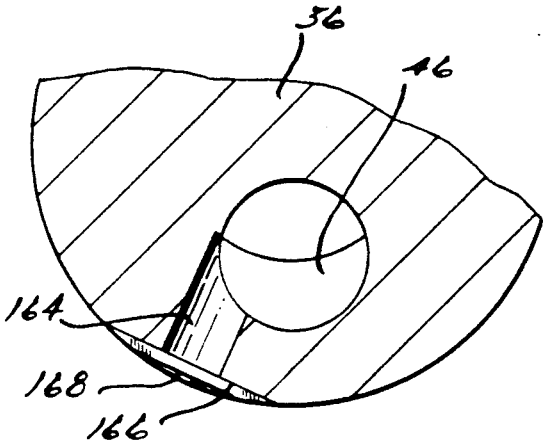
FIG. 9 is an enlarged fragmentary section view of the drive shaft of FIG. 8, the section being taken along line 9—9 thereof.

As shown in FIG. 5, thrust washer 110 is generally circular in shape with a radially outwardly extending anti-rotation tab 124 provided thereon which is received within a relatively small diameter counterbore 126 provided in bearing housing 28, counterbore 126 being positioned in overlapping relationship to counterbore 104. Thrust washer 110 also includes a center opening 128, a pair of substantially identical arcuate inlet openings 130, 132 positioned on opposite sides of and substantially equidistantly radially outwardly from opening 128 and a pair of arcuate outlet openings 136, 138 also positioned on opposite sides of and substantially equidistantly radially outwardly from openings 130, 132. Inlet openings 130, 132 are positioned so as to underlie and open into annular recess 118 of pump impeller 106 whereas outlet openings are positioned so as to underlie and align with the outer ends of passages 120 of impeller 106.

Plate member 112 is also generally circular in shape and includes a radially outwardly extending tab portion 140 which is also received within counterbore 126 to prevent rotation thereof. Also a pair of arcuately shaped inlet openings 142, 144 are provided which are positioned so as to align with openings 130, 132 respectively in thrust washer 110. An irregularly shaped channel or recess is also provided in the upper surface of plate member 112 and includes a pair of generally semi-circularly shaped outer portions 146, 148 each of which has its opposite ends opening into a generally diametrically extending portion 150. Circular shaped portions 146, 148 are positioned so as to underlie respective outlet openings 136, 138 provided in thrust washer 110 whereas diametric portion 150 provides fluid communication to passage 44 in crankshaft 36 via openings 128 and 107 in thrust washer 110 and impeller 106 respectively.

As previously mentioned, impeller 106 of primary pump 50 is rotatably driven by crankshaft 36. In order to accomplish this objective, upper portion 108 of impeller 106 is provided with a pair of diametrically opposed radially outwardly projecting axially elongated protrusions 152, 154 each of which is received within a counterbore 156 provided in the lower end of crankshaft 36.

In operation, oil from the lower portion of shell 10 is drawn into annular recess 118 of impeller 106 via inlet openings 142, 144 and 130, 132 in lower plate 112 and thrust washer 110 respectively. As impeller 106 is rotatably driven by crankshaft 36, the oil will be thrown or pumped radially outwardly through respective passages 120 and thence through outlet openings 136, 138 in thrust washer 110 into channels 146, 148 in lower plate 112. From channel portions 146, 148, the now pressurized oil will flow to channel portion 150 then axially upwardly through openings 128 and 107 into passage 44 in crankshaft 36. At this point the centrifugal force on the oil resulting from rotation of the crankshaft will provide a second stage or secondary pumping action to thereby assure an adequate supply of oil is provided to the bearing surfaces.

As noted above, it is common for such hermetic refrigeration compressors to have refrigerant intermixed with the oil. During the above described pumping action, a portion of this refrigerant is drawn into the primary pump 50 and flashed to a gaseous state. It is believed this flashing of the refrigerant is due in part to the acceleration of the refrigerant oil mixture as it moves into passages 120. In the present invention, however, any such flashed refrigerant will be vented through passages 122 into counterbore 100 and thereafter through passage 105 thereby avoiding the possibility that this gaseous refrigerant may restrict the supply of oil to the various bearing surfaces.

It is also possible that not all the refrigerant entrained in the oil will be flashed during this first stage pumping action but rather a portion may be carried over along with the oil to passages 44 and 46. In order to vent any such refrigerant, passage 46 is provided with a generally radially extending vent passage 158 opening outwardly just below upper bearing 40. In order to avoid the possibility that passage 158 may become filled with oil and thereafter act as a centrifugal pump, a first portion 160 thereof extending from about the axis of rotation of crankshaft 36 radially outwardly is of substantially greater diameter than the portion 162 extending from passage 46 to the axis of rotation. Thus, portion 162 will restrict the amount of oil flowing into portion 160 such that it will not be possible for it to become primed regardless of the volume of oil flowing through passage 46.

In order to supply lubricant to main bearing 40, an outlet passage 164 is provided adjacent the lower end thereof. An axially elongated flat 166 provided on crankshaft 36 extends from outlet passage 164 upwardly to the lower end of crank pin 38. A smaller axially extending flat 168 is also provided extending downwardly below outlet opening 164 to the lower end of bearing 40. Flats 166 and 168 serve to provide a slight clearance between bearing 40 and crankshaft 36 whereby oil flow out of outlet 164 will be distributed over the entire axial length of bearing 40. Additionally flat 166 serves to vent any gaseous refrigerant from bearing 40.

In order to avoid the possibility of foreign particles being continuously circulated to the bearings with the oil, a filter 170 is also provided. Filter 170 comprises a generally circularly shaped screen member having a center opening therein through which the pump housing portion of lower bearing housing 28 extends. A suitable snap ring 172 is fitted within an annular groove so as to retain filter 170 in assembled relationship therewith. The outer peripheral edge of filter 170 is seated on a shoulder 174 formed on base 14 and is clamped thereagainst by the lower edge of cylindrical shell 10. Preferably, filter 170 will be formed from a relatively fine mesh stainless steel screen material. Because filter 170 effectively encircles the inlet to primary pump 50, any foreign particles will be separated from the oil as it flows downwardly therethrough thus assuring they will not be circulated to the bearing surfaces. It should also be noted that filter 170 has a substantial surface area and hence will not restrict oil flow to pump 50 even with an accumulation of foreign particles thereon. In addition to separating foreign particles from the lubricating oil, it is also believed that filter 170 will aid in inhibiting gaseous refrigerant from being drawn into pump 50.

As may now be appreciated, the present invention provides a significantly improved lubrication system for refrigeration compressors which system assures an adequate supply of oil to the bearing surfaces under all operating conditions. The provision of a two stage pump with a venting arrangement incorporated into the first stage renders the present system particularly well suited for use in variable speed compressors as it insures an adequate supply of lubricating oil will be supplied to the bearings even during extended periods of low speed operation. Further, the restricted crankshaft passage venting arrangement assures that venting of the upper lubricant distribution passages, while also preventing the possibility that these passages could become primed and thereby act to pump lubricant away from the intended destinations. The inclusion of a filter surrounding the inlet to the oil pump also contributes to extended compressor life in reducing the possibility of foreign particles being circulated with the lubricating oil.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. In a refrigeration compressor comprising an outer shell having a lubricant containing sump in a lower portion thereof, compressor means disposed within said shell, said compressor means including motor means operative to drive said compressor means, a drive shaft interconnecting said compressor means and said motor means, pump means disposed in said sump and operative to pump lubricant from said sump to said compressor means, said drive shaft having an axially extending passage provided therein for supplying lubricant from said pump means to said compressor means, said pump means including a housing having means defining a pumping chamber, inlet and outlet passages communicating with said pumping chamber and a pumping member within said chamber for drawing lubricant from said sump through said inlet and discharging said lubricant through said outlet, the improvement comprising first vent means in said housing opening outwardly from said pumping chamber and second vent means in said pumping member communicating with said first vent means in said housing whereby refrigerant gas carried by said lubricant may be vented from said pump, and vent means in said drive shaft extending generally radially from said passage means to the outer surface of said drive shaft, said vent means including a first portion extending from said passage to approximately the axis of rotation of said drive shaft and a second portion extending to said outer surface, said second portion having a cross sectional areas greater than said first portion.

2. In a refrigeration compressor comprising an outer shell having a lubricant containing sump in a lower portion thereof, compressor means disposed within said shell, said compressor means including motor means operative to drive said compressor means, pump means disposed in said sump and operative to pump lubricant from said sump to said compressor means, said pump means including a housing having means defining a pumping chamber, inlet and outlet passages communicating with said pumping chamber and a pumping member within said chamber for drawing lubricant from said sump through said inlet and discharging said lubricant through said outlet, the improvement comprising first vent means in said housing opening outwardly from said pumping chamber and including exit opening in the housing wall is below the lubricant level in said sump, and second vent means in said pumping member communicating with said first vent means in said housing whereby refrigerant gas carried by said lubricant may be vented from said pump into said sump.

3. A compressor as set forth in claim 2 wherein said pump means is a two stage pump and said second vent means is positioned between said inlet and the outlet of a first of said two stages.

4. A compressor as set forth in claim 3 wherein said compressor is a variable speed compressor.

5. A compressor as set forth in claim 2 wherein said second vent means comprises a plurality of openings extending through said pumping member.

6. A compressor as set forth in claim 5 wherein said housing includes an annular chamber for placing said plurality of second vent openings in communication with said first vent means.

7. A compressor as set forth in claim 2 further comprising filter means within said sump surrounding said pump inlet.

8. A compressor as set forth in claim 2 further including a drive shaft interconnecting said motor means and said compressor means, one end of said drive shaft extending into said housing, said pumping member comprising an impeller having a portion fitted within said one end of said drive shaft, said impeller having an annular recess in communication with said pump inlet and a plurality of circumferentially spaced passages extending outwardly therefrom, each of said passages having a step portion at approximately the juncture of said passage with said annular recess.

9. A compressor as set forth in claim 8 wherein said second vent means are positioned radially outwardly of said drive shaft.

10. A compressor as set forth in claim 8 wherein said second vent opens into said passage immediately adjacent said step.

11. A compressor as set forth in claim 10 wherein said step is defined by an increase in the axial depth of said passage.

12. A compressor as set forth in claim 11 wherein each of said passages extend outwardly along a chord of said pumping member.

13. In a refrigeration compressor comprising an outer shell having a lubricant containing sump in a lower portion thereof, compressor means disposed within said shell, said compressor means including motor means operative to drive said compressor means and pump means having an inlet communicating with said sump, said pump means being operative to supply lubricant to said compressor means from said sump, the improvement comprising filter means within said sump, said filter means extending from said pump means to said shell in surrounding relationship to said pump inlet to thereby inhibit flow of foreign particles through said pump means to said compressor means.

14. A compressor as set forth in claim 13 wherein said pump means includes a housing and said filter means extends generally radially between said pump housing and said outer shell.

15. A compressor as set forth in claim 14 wherein said outer shell comprises a base portion having an annular recess and a cylindrical portion received within said recess, a peripheral edge of said filter means being clamped between said cylindrical portion and said base portion.

16. A compressor as set forth in claim 13 wherein said filter means comprises a sheet material having a plurality of openings therethrough.

17. A compressor as set forth in claim 16 wherein said filter means extends radially outwardly from said pump means.

18. A compressor as set forth in claim 13 wherein said pump means further includes an outlet and a vent passage extending between said sump and said pump means, said vent passage communicating with said pump means between said inlet and said outlet to thereby return refrigerant entering said pump means to said sump.

19. A compressor as set forth in claim 18 further comprising a drive shaft interconnecting said motor means and said compressor means, said pump means comprising a two stage pump directly driven by said drive shaft.

20. A compressor as set forth in claim 19 wherein said vent passage communicates with said pump means between said inlet and an outlet of the first of said two stages.

21. A compressor as set forth in claim 13 further comprising a drive shaft interconnecting said motor means and said compressor means, said drive shaft having an axially extending passage for supplying lubricant from said pump means to said compressor means and vent means provided intermediate the ends of said drive shaft for venting refrigerant from said axially extending passage.

22. A compressor as set forth in claim 21 wherein said vent means comprises a generally radially extending passage having a first portion opening into said axially extending passage and a second portion opening outwardly through the outer sidewall of said drive shaft, said second portion having a cross section substantially greater than the cross section of said first portion.

23. A compressor as set forth in claim 22 wherein said first and second portions meet substantially at the axis of rotation of said drive shaft.

24. In a refrigeration compressor comprising an outer shell having a lubricant sump in a lower portion, compressor means disposed within said shell, said compressor means including a compressor, motor means, a drive shaft drivingly connecting said motor means to said compressor means, one end of said drive shaft extending into said lubricant sump, bearing means for rotatably supporting said drive shaft, and axially extending passage means within said drive shaft for conducting lubricant from said sump to said bearing means, the improvement comprising generally radially extending vent means in said drive shaft intermediate the ends thereof, said vent means including a first restricted portion opening into said axially extending passage and a second portion opening outwardly of said drive shaft, said vent being operative to allow flow of gaseous refrigerant from said axial passage and to resist flow of lubricant therethrough.

25. A compressor as set forth in claim 24 wherein said second portion has a cross section substantially greater than said first portion.

26. A compressor as set forth in claim 24 wherein said vent means comprises a passage extending across the axis of rotation of said drive shaft.

27. A compressor as set forth in claim 26 wherein said first and second portions meet at approximately the axis of rotation of said drive shaft.

28. A compressor as set forth in claim 24 further comprising an oil outlet passage for supplying lubricant to said bearing means, said drive shaft having an axially elongated flat, said outlet passage opening outwardly at said flat, said flat being axially coextensive with said bearing means so as to aid in distribution of said lubricant over the axial length of said bearing means.

29. A compressor as set forth in claim 28 wherein said flat includes a first portion extending upwardly from said opening and a second portion extending downwardly from said opening, said first portion having a width in a circumferential direction greater than said second portion, said first portion further being operative to vent refrigerant from the area between said drive shaft and said bearing means.

30. A variable speed refrigeration compressor comprising:

an outer shell having a lubricant sump in a lower portion thereof;

compressor means within said shell;

motor means;

a drive shaft drivingly interconnecting said motor means and said compressor means, one end of said drive shaft extending into said supply of lubricant in said sump;

bearing means rotatably supporting said drive shaft;

primary pump means drivenly connected to said one end of said drive shaft and having an inlet and an outlet;

secondary pump means within said drive shaft, said secondary pump means having an inlet connected to said outlet of said primary pump means and an outlet;

passage means within said drive shaft for supplying lubricant from said outlet of said secondary pump means to said bearing means; and vent means for said primary pump means extending outwardly from between said inlet and said outlet thereof and opening directly into sump, said vent means being operative to vent refrigerant drawn into said primary pump means.

31. A compressor as set forth in claim 30 wherein said primary pump means includes an impeller drivingly connected to said drive shaft and said vent means includes a plurality of axially extending passages provided in said impeller.

32. A compressor as set forth in claim 31 wherein said bearing means include upper and lower bearings provided in respective upper and lower bearing housings, said impeller being rotatably supported within said lower bearing housing and said vent means further comprises vent passage means in said lower bearing housing communicating between said plurality of axially extending passages in said impeller and said sump.

33. A compressor as set forth in claim 32 wherein said vent means include an annular chamber in said lower bearing housing overlying said impeller, said plurality of axial passages opening into said chamber and said vent passage means extending from said chamber to said sump.

34. A compressor as set forth in claim 32 wherein said impeller includes an annular inlet chamber and a plurality of circumferentially spaced pumping passages extending outwardly therefrom, each of said plurality of axial passages opening into each of said plurality of pumping passages adjacent its juncture with said inlet chamber.

35. A compressor as set forth in claim 34 wherein each of said pumping passages includes a step, said step providing an increased flow area downstream thereof.

36. A compressor as set forth in claim 30 further comprising filter means within said sump, said filter means being operative to inhibit ingestion of foreign particles entrained within said lubricant by said primary pump.

37. A compressor as set forth in claim 36 wherein said primary pump means is disposed within a lower bearing housing and said filter means extends between said lower bearing housing and said outer shell in surrounding relationship to said primary pump inlet.

38. A compressor as set forth in claim 30 further comprising a restricted vent passage in said drive shaft for venting refrigerant from said passage means, said restricted vent passage extending from said passage means to an outer surface of said drive shaft intermediate the ends thereof.

39. A compressor as set forth in claim 38 wherein said restricted vent passage includes a first portion of a predetermined diameter opening into said passage means and a second portion of a diameter greater than said predetermined diameter extending to said outer surface of said drive shaft.

40. A compressor as set forth in claim 38 further comprising filter means within said sump, said filter means being operative to inhibit ingestion of foreign particles entrained within said lubricant by said primary pump.

41. A compressor as set forth in claim 38 further comprising an oil outlet passage for supplying lubricant to said bearing means, said drive shaft having an axially elongated flat, said outlet passage opening outwardly at said flat, said flat being axially coextensive with said bearing means so as to aid in distribution of said lubricant over the axial length of said bearing means.

42. A compressor as set forth in claim 41 wherein said flat includes a first portion extending upwardly from said opening and a second portion extending downwardly from said opening, said first portion having a width in a circumferential direction greater than said second portion, said first portion further being operative to vent refrigerant from the area between said drive shaft and said bearing means.

* * * * *

UNITED STATES PATENT AND TRADEMARK OFFICE

CERTIFICATE OF CORRECTION

PATENT NO. : 5,176,506

DATED : January 5, 1993

INVENTOR(S) : Stephen M. Seibel

It is certified that error appears in the above-identified patent and that said Letters Patent is hereby corrected as shown below:

On the title page under "United States Patent", "Siebel" should be -- Seibel --.

On the title page under "Inventor", "Siebel" should be -- Seibel --.

Column 3, line 60, "know" should be -- known --.

Column 7, line 16, "areas" should be -- area --.

Column 9, line 20, after "vent" insert -- means --.

Column 9, line 59, "drivenly" should be -- drivingly --.

Column 10, line 3, after "into" insert -- said --.

Signed and Sealed this

Sixteenth Day of November, 1993

*Attest:*

Bruce Lehman

BRUCE LEHMAN

*Attesting Officer*

*Commissioner of Patents and Trademarks*